United States Patent [19]

Zawierucha

[11] Patent Number: 4,473,110

[45] Date of Patent: Sep. 25, 1984

[54] CORROSION PROTECTED REVERSING HEAT EXCHANGER

[75] Inventor: Robert Zawierucha, East Aurora, N.Y.

[73] Assignee: Union Carbide Corporation, Danbury, Conn.

[21] Appl. No.: 336,248

[22] Filed: Dec. 31, 1981

[51] Int. Cl.[3] ..... F28F 19/02

[52] U.S. Cl. ..... 165/133; 165/134 R; 428/933

[58] Field of Search ..... 165/133, 97, 134 R; 204/196, 147; 428/933

[56] References Cited

U.S. PATENT DOCUMENTS

| | | | |
|---|---|---|---|
| 3,152,059 | 10/1964 | Wellington | 428/933 |
| 4,056,142 | 11/1977 | Baumann et al. | 165/133 |
| 4,062,189 | 12/1977 | Mager et al. | 165/97 |
| 4,131,155 | 12/1978 | Thorogood | 165/97 |
| 4,148,971 | 4/1979 | Kawano et al. | 428/558 |
| 4,203,490 | 5/1980 | Terai et al. | 165/134 R |

FOREIGN PATENT DOCUMENTS

| | | | |
|---|---|---|---|
| 68596 | 5/1980 | Japan | 165/133 |

OTHER PUBLICATIONS

*Flame Spray Handbook*, vol. 1, "Wire Process" by H. S. Ingham and A. P. Shepard, published by Metco Inc., Westbury, Long Island, N.Y., 1964, Catalog No. 4E555.

*The Corrosion of Light Metals*, H. P. Godard et al., John Wiley & Sons, Inc., (pp. 31, 185–192).

"New Zinc-Based Alloy for Metallizing", by M. Leclercq and R. Bensimon, Eighth International Thermal Spraying Conference, Miami Beach, Florida, Sep. 27–Oct. 1, 1976.

"Electrochemical and Corrosion Properties of Thermally Sprayed Coatings of Aluminum Alloys", by V. Vesely and J. Horky, State Research Institute for the Protection of Materials, Czechoslovakia, Eighth International Thermal Spraying Conference, Miami Beach, Fla., Sep. 27–Oct. 1, 1976.

"Sea Water Corrosion Test of Aluminum 6061 Alloy with XB605 Alloy Anodes", by J. L. Basil, U.S. Naval Engineering Experiment Station, R & D Report 040039K, Mar. 22, 1957.

*Primary Examiner*—Albert W. Davis, Jr.
*Assistant Examiner*—S. Gayle Dotson
*Attorney, Agent, or Firm*—E. Lieberstein

[57] ABSTRACT

A reversing heat exchanger of the plate and fin type having multiple aluminum parting sheets in a stacked arrangement with corrugated fins separating the sheets to form multiple flow paths, means for closing the ends of the sheets, an input manifold arrangement of headers for the warm end of the exchanger and an output manifold arrangement for the cold end of the exchanger with the input air feed stream header and the waste gas exhaust header having an alloy of zinc and aluminum coated on the inside surface for providing corrosion protection to the stack.

4 Claims, 6 Drawing Figures

CORROSION PROTECTED REVERSING HEAT EXCHANGER

This invention relates to brazed plate type reversing heat exchangers and more particularly to a brazed aluminum heat exchanger having a manifold assembly for providing indirect corrosion protection to the brazed aluminum heat exchanger core.

BACKGROUND OF THE INVENTION

Commercial air separation practice involves the distillation of air at cryogenic temperature levels. The distillation of the air process stream occurs at temperature levels of about 80°-100° K. compared to ambient conditions of about 300° K. The separation process includes the use of appropriate heat exchangers to cool the feed air from ambient to distillation temperatures and recover the refrigeration from the separated cold return streams. The air desuperheating step is typically performed at relatively low temperature differences in order to avoid large energy expenditures. The heat exchangers typically utilized are of a plate and fin construction which are fabricated by stacking alternate layers of aluminum parting sheets and corrugated fin stock and brazing the entire structure to form the required mechanical rigidity. The heat exchangers commonly used for the air desuperheating step have an additional function that involves the removal of the usual atmospheric air contaminants such as water and carbon dioxide. Such process arrangement utilizes what is commonly referred to as the reversing heat exchanger (RHX) arrangement in which air contaminants which deposit on a given heat exchanger passage during a portion of the operation are removed by subsequent removal of that passage from air service and sweeping that passage with waste nitrogen to remove the contaminant. The reversing heat exchanger arrangement utilizes the difference in pressure between the air feed stream and returning waste nitrogen stream to remove the contaminant from the air stream and prevent clogging of downstream processing equipment.

Since the air separation process typically utilizes ambient air compressed to an increased pressure of about 90-100 psia, it is common for the feed air stream to be substantially saturated with water vapor at the entrance to the reversing heat exchanger section. As the air proceeds to cool, the water vapor is condensed and forms a liquid film on the heat exchanger surfaces. As the air continues to cool a point is reached where the temperature corresponds to the freezing point of water and the water vapor then continues to be removed but is deposited directly as a snow or ice film on the surfaces. At still lower temperature levels, the carbon dioxide contaminant begins to plate out and is again removed as a snow or solid film on the heat exchanger surface. During the subsequent cleaning stroke of the reversing heat exchanger sequence, the waste nitrogen serves to revaporize the carbon dioxide and water and remove it from the heat exchanger. This sequential switching of the heat exchanger passages maintains the surfaces in a relatively clean and functional manner and prevents the introduction of the contaminants into the colder regions of the process equipment where the solid materials would serve to impede the operation of the equipment. Since ambient air available in typical industrial environments often contains trace quantities of corrosive elements such as sulfur compounds, chlorine compounds, or other compounds, these components are carried along with the air into the reversing heat exchangers. The water film that generally coats the upper regions of the reversing heat exchangers tends to concentrate these contaminants and form a mildly corrosive solution that attacks the aluminum material of the heat exchanger. Over a substantial operating period, such corrosive attack of the aluminum heat exchanger may eventually cause mechanical failure of the heat exchanger and thereby require replacement of the unit.

Since the corrosion of the aluminum reversing heat exchanger due to atmospheric contaminants concentrated in the water condensate has been a continual problem, and leads to additional expense associated with the replacement of the heat exchanger units, many attempts have been made in the past to solve the corrosion problem. The brazed aluminum heat exchangers utilized for the air desuperheaters are of the plate and fin design. Such units involve specialized and costly furnace brazing operations following the stacking of the parting sheets and corrugated fins that make up the heat exchanger core. The heat exchanger parting sheets that form the passage low channels are relatively thin aluminum stock ranging from 16 to 64 mils in thickness and corrosion protection of these elements are extremely important to heat exchanger life. Direct corrosion protection to the parting sheets and/or corrugated fins would complicate the brazing operations and substantially increase the fabrication cost of the heat exchanger. Therefore only indirect corrosion protection to the heat exchanger, particularly the core, is practical. Previous attempts to provide indirect corrosion protection by the brazed aluminum heat exchanger core have been associated with procedures and techniques involving treatment of the upstream air supplied to the heat exchanger. These attempts to solve the problem have included the use of galvanized air piping upstream of the heat exchanger, use of zinc demister pads in air inlet piping, and proposals to insert sacrificial zinc alloy anodic bar members in the air stream to afford cathodic protection to the downstream aluminum heat exchanger core. None of the above methods have been entirely satisfactory for various reasons.

The use of zinc coated or galvanized piping has served to protect the air piping but offers only small improvements for corrosion reduction of the heat exchanger core. The air piping itself is constructed of relatively heavy stock material and thereby corrosion of that member is not a problem. From a galvanic action standpoint, the zinc attached to the piping has little or no impact on corrosion inhibition in the heat exchanger core. The zinc demister pad technique was partially successful in that it would serve to remove suspended and entrained water condensate (with its dissolved corrosives) and prevent its detrimental action on the downstream heat exchanger. However, it has little effect on water content associated with the saturated air which would of course deposit on the heat exchanger as the air was cooled. Still additionally, that technique was a problem because with continued service the screen members associated with the pad would corrode and degenerate and eventually break off and carryover as undesirable debris into the inlet of the heat exchanger. Of course, when this breakage of the screen took place, any subsequent protection for the heat exchanger was not available. The anodic member suspended in the air inlet stream was not entirely satisfactory for at least two reasons. First, it is difficult to expose all or substantially all of the air stream to the associated anodic action by the insertion of one or more members into the air flow. Second, such insertion of bar members into the air flow imposed an undesirable air flow restriction in the inlet piping. Trial field tests indicated that with eventual corrosion and degradation of the anodic members there was subsequent breakage and carryover of such members into the air heat exchanger. This again served to introduce undesirable debris into the inlet of the heat exchanger.

The continuing problem associated with the corrosion of reversing heat exchangers and undesirable features associated with the various attempts to solve the problem set the stage for the improved corrosion protection technique associated with this invention. It was discovered that indirect corrosion protection of the aluminum heat exchange core could be achieved by employing a manifold arrangement of headers in which predetermined headers are coated to function as sacrificial anodes in addition to directing fluid flow into preselected fluid channels. The coated headers indirectly provide corrosion protection to the aluminum core of the heat exchanger. Only the air and waste nitrogen headers are coated using a composition of zinc and aluminum preferably a zinc aluminum alloy. Such coating is preferably applied by any conventional thermal spray process. Additionally, the alloy coating should be strategically located directly upstream of the aluminum heat exchanger core at the warm end thereof. The cathodic corrosion protection established by the applied coating is due to the electrical action between the applied coating and the aluminum core with the circuit required for such electrical action formed by the water condensate film present in the heat exchanger. Test work has shown that the water condensate film associated with reversing heat exchanger operation can supply sufficient electrical conductivity to afford cathodic protection to the uncoated heat exchanger core downstream of the coated headers. It is common practice to use a sacrificial anode only under immersion conditions with a ready electrolytic conductive path. The dissolution of the sacrificial anode alloy coating serves to inhibit the corrosive activity otherwise due to the solution of corrosive agents normally present in the ambient feed air.

SUMMARY OF THE INVENTION

The reversing heat exchanger design of the present invention inhibits corrosion of the aluminum core by the application of a predetermined sacrificial anode coating located directly upstream of the aluminum heat exchanger core along the internal surfaces of the air and waste nitrogen headers at the warm end of the core respectively. The predetermined coating composition comprises zinc and aluminum in combination with the zinc content ranging from 3–100% of the total composition with a preferred range of 10–65% zinc and an optimum range of 20–50% zinc. The coating thickness should range from about 10 to 50 mils.

OBJECTIVES

It is an object of the present invention to provide a brazed aluminum heat exchanger having a manifold assembly which functions to provide indirect corrosion protection to the brazed aluminum heat exchanger core.

It is another object of the present invention to provide a brazed aluminum heat exchanger having a manifold asssembly operating as a sacrificial anode for inhibiting corrosion in the brazed aluminum heat exchanger core downstream of the manifold assembly.

It is a further object of the present invention to provide a brazed aluminum heat exchanger having a manifold assembly including a predetermined zinc alloy coating on predetermined fluid stream headers to provide the function of sacrificial anodes relative to the brazed aluminum heat exchanger core. Other objects and advantages of the present invention will become apparent from the following detailed description of the invention when read in conjunction with the accompanying drawings of which:

Figure 1:
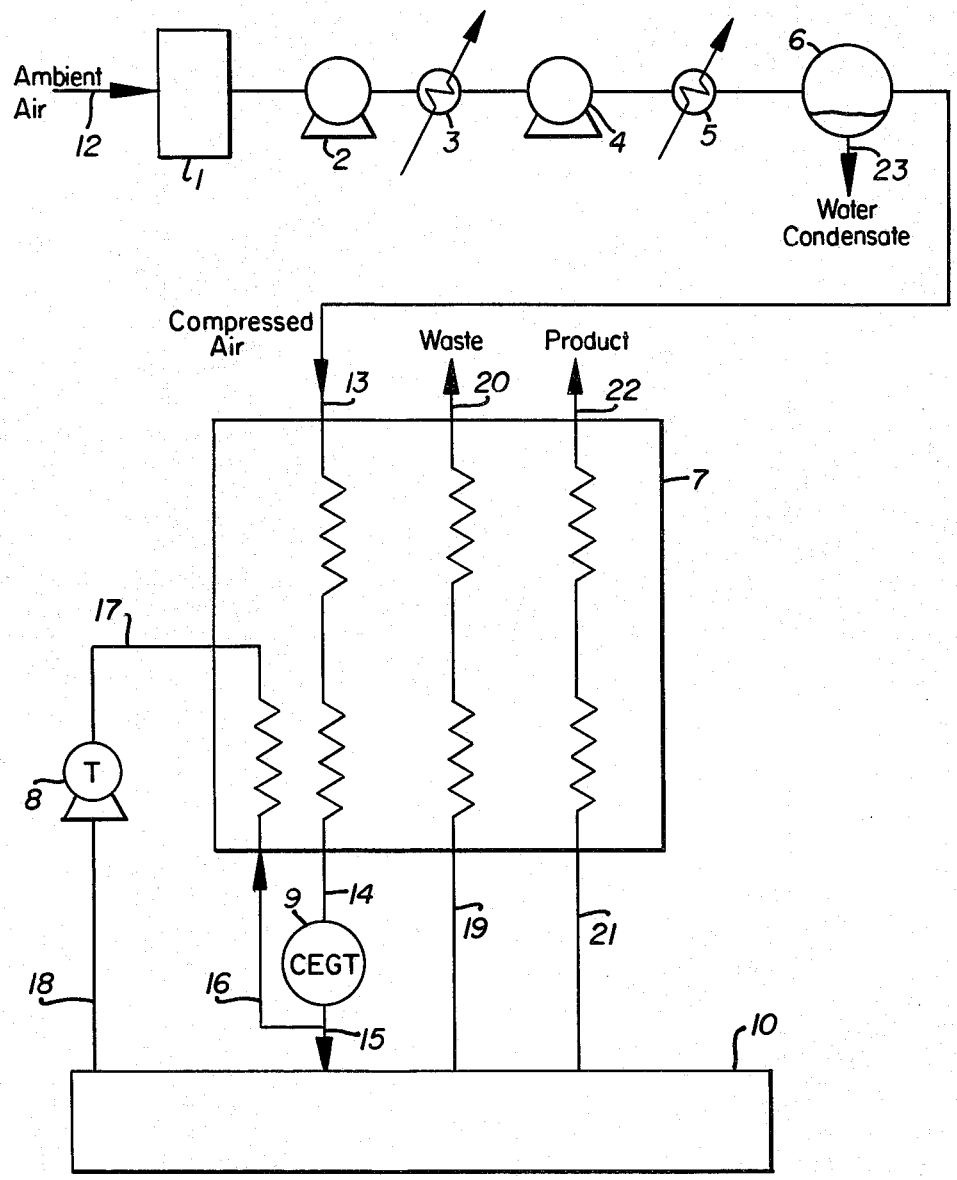
FIG. 1 illustrates a typical air separation process utilizing reversing heat exchanger units in accordance with the present invention.

Referring now to FIG. 1 illustrating a typical air separation system using reversing heat exchangers for the cryogenic distillation of air to produce a desired product such as oxygen. Ambient air 12 is filtered in filter 1 to remove suspended particles followed by multi-stage compression of the feed air stream.

The air compression is usually performed in multistage centrifugal units 2 and 4 utilizing both water inter cooling 3 and after water after cooling 5. As the air is compressed, its ability to retain its moisture content as water vapor is decreased until, dependent on the initial relative humidity, the saturation point is exceeded and some water vapor is condensed from the compressed air stream. Such condensed water is removed in an appropriate liquid trap 6 of conventional design associated with the air compressor so that the compressed air stream 13 following the air compression step is essentially a pressurized and water saturated stream. Of course, the air stream may contain excess water content in the form of entrained liquid droplets depending on the efficiency and extent of water condensate removal 23. Typically, the water removal is quite effective but does result in some residual free water content in the air stream. It should be noted that in some cases the aftercooling step following the final stage of air compression is done with a direct contact aftercooler which involves the countercurrent cooling of the air stream with the cooling water in an appropriate trayed column vessel. Such a process step would usually result in closer temperature approach of the air stream with the cooling water, but on the other hand, may result in somewhat additional entrainment of free water. The major point to be made is that following air compression to normal head pressures of 80 to 120 psia, it is expected for the air stream to be saturated or close to saturated with water vapor and additionally the compressed air stream may have some residual free water entrained in the gas flow. Any corrosive agents present in the environment surrounding the air plant location have a tendency to be concentrated in the associated water condensate and are thereby carried along with the air stream and introduced into the inlet of the reversing heat exchanger unit. The air feed enters the air desuperheater reversing heat exchanger unit 7 and is cooled versus the returning streams from the column section 10 of the plant. The compressed air 13 is cooled to an air stream 14 at close to its saturation temperature. Generally, the cooled air stream 14 is maintained several degrees above saturation temperature to avoid liquid air within the RHX unit or within the cold end gel traps (CEGT) 9 used to remove residual carbon dioxide from the air feed stream. Thus, the air may be cooled from an ambient condition of about 300° K. to about the 100° K. temperature level. On the other hand, the return streams (waste and product) are warmed from relatively low temperature levels of perhaps 98° K. up to essentially the ambient condition of about 297° K. The general temperature profile will exhibit a low temperature difference at the warm end and cold end of the reversing heat exchanger with an increasing temperature difference at the midpoint of the heat exchanger. This increase at the midpoint is due to a difference in the specific heat of the compressed air feed versus the low pressure return streams and is conventionally handled as shown in FIG. 1 by using a portion 16 of the compressed and cooled air stream as an unbalance stream at the cold end section of the reversing heat exchanger (RHX) unit. Following rewarming 17 in the unbalance pass, this air stream is expanded in turbine 8 to develop plant refrigeration and introduced as an expanded feed stream 18 into the low pressure column of the plant. The reversing heat exchanger unit has three operation zones. The first zone is at the warm end of the heat exchanger and is a water removal zone which is that length of the heat exchanger associated with temperature levels that correspond to the moisture being removed as the air stream is cooled and extends generally over about 15% of the length of the heat exchanger core. Another zone at the cold end of the heat exchangers corresponds to a carbon dioxide removal zone whereby the carbon dioxide impurity is deposited on the surfaces of the heat exchangers and thereby removed. The middle section, generally at increased temperature difference, can be thought of as a normally clean zone of the heat exchanger. The reversing heat exchanger method of operation depends on utilization of two passes within the heat exchanger; one associated with the air and another associated with the waste nitrogen. During the deposition phase of the cycle, the water and carbon dioxide contaminants are deposited within the air passon the corresponding lengths of the heat exchanger. After some predetermined time period dependent upon design parameters such as pressure drop and heat transfer, but usually about 10 minutes, this pass is removed from air service and put into waste nitrogen service, whereas the previous waste nitrogen pass is switched to air service or the heat exchanger is reversed. For the cleaning phase of the cycle, the waste nitrogen at the lower pressure serves to revaporize the carbon dioxide and water into the returning waste nitrogen stream and thereby removes the contaminants from the unit. Following a period of operation at sweep conditions, the pass is cleaned and then the recycle is repeated. Accordingly the corrosion problem associated with any corrosive agents that may be present in the water condensate is associated with that length of the heat exchanger that is exposed to liquid water. Obviously, once a temperature level is reached where the water is deposited on the surfaces as a solid, any corrosive action would be substantially inhibited and not of practical significance. Likewise, the solid carbon dioxide plating on the surfaces at the colder temperatures has no corrosive impact. Past experience has indicated that structural failures due to corrosion occur in the first zone of the reversing heat exchanger unit or the length that corresponds from the warm end inlet to the water freezing level.

Although the particular length of reversing heat exchanger associated with liquid water is dependent on many design parameters as reflected in the available temperature difference for heat transfer, typical conditions are such that the length exposed to liquid water may range from 1 to 4 feet. Typically, the warm end RHX lengths exposed to water condensate are about 2 to 3 feet. It is thus apparent as based on the aforementioned theory that any corrosion protection that will inhibit corrosion in the first several feet of the heat exchanger at the warm end thereof and includes both the air and waste nitrogen passes (since these alternate for air service) will extend reversing heat exchanger life. Length beyond that initial warm end length is not exposed to deterimental corrosion agents and neither are other passes associated with any of the return product streams or any of the cold end unbalance streams.

Figure 2:
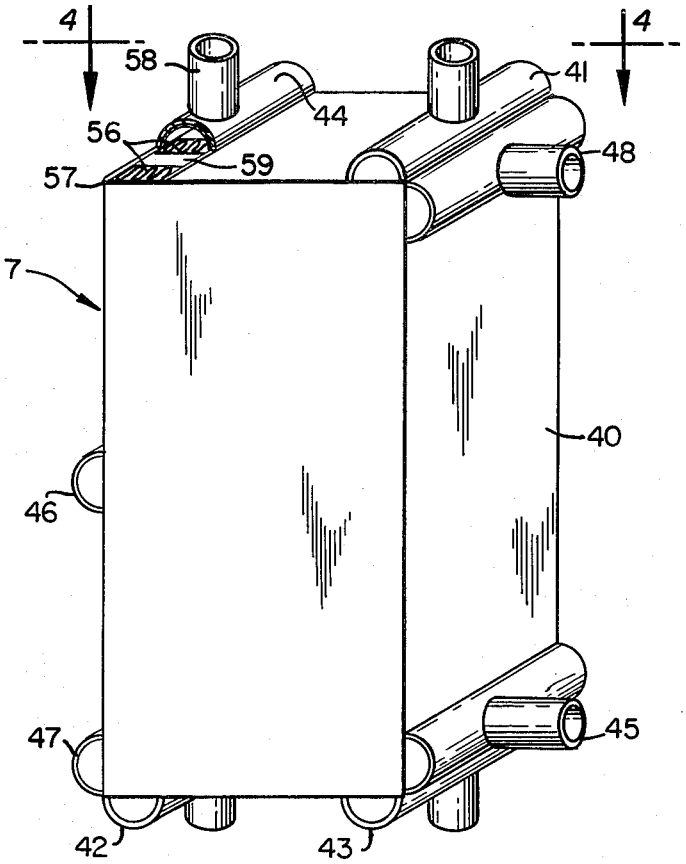
FIG. 2 illustrates in perspective the brazed aluminum heat exchanger unit of FIG. 1 with the air and nitrogen headers partially cut-away to expose the sacrificial anode protective coating as well as to expose the fin construction in the heat exchanger core.

The typical configuration of the reversing heat exchanger unit 7 is illustrated in FIG. 2. As can be seen, the unit 7 is composed of a heat exchanger core 40 of stacked heat transfer passages with appropriate manifold or headers designated by reference numerals 41–48 to handle all of the required streams. The manifold function will be more elaborately explained with reference to FIGS. 3 and 4. For carrying out the process associated with FIG. 1, the RHX unit 7 would include three warm end headers 41, 44 and 48; four cold end headers 42, 43, 45 and 47 and one side header 46. The unbalance stream would flow through inlet cold end header 45 and exit through side header 46. The feed air stream would enter warm end header 41 and exit cold end header 42. In similar fashion, the waste stream would enter header 43 and exit header 44, whereas, the product stream would enter header 47 and exit at the warm end through header 48. As previously described, the air and waste headers would be periodically switched to maintain self-cleaning operation of the RHX unit. Note that for multiproduct application such as for various combinations of oxygen and nitrogen, additional headers would be required.

Figure 3:
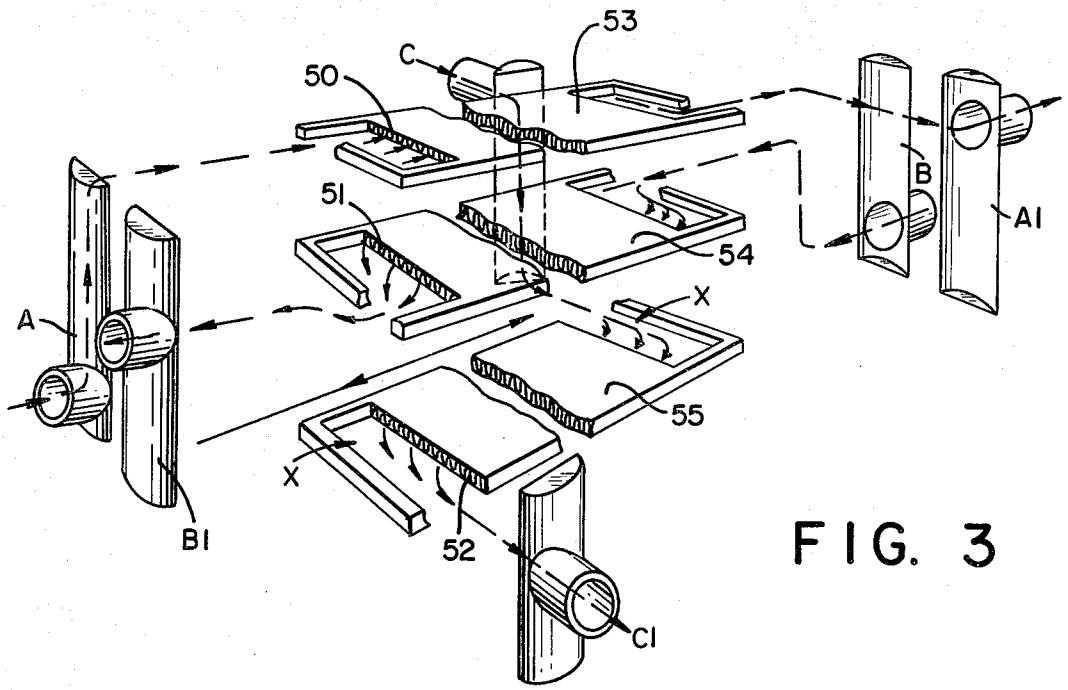
FIG. 3 illustrates in perspective the way headers are used to manifold air, waste and product fluid streams through the flow passages in a heat exchanger core.

The base core 40 of the reversing heat exchanger unit 7 is assembled by stacking a multiple number of flat aluminum sheets, known as parting sheets, in a superimposed parallel relationship with each sheet spaced a fixed distance apart from one another. The marginal ends of the sheets along the sides, front and back are connected together through spacing bars known as end and side bars. The separated parting sheets define fluid passages for the passage of heat exchange fluid. The passages are filled with thin corrugated fin packing material to support the parting sheets and to provide extended heat transfer surfaces. The corrugated fin material 56 as shown in FIG. 2 fill passageway 57 which open into header 44 where their flow is combined and carried through the waste outlet nozzle 58. Blocking strips such as strip 59 are used, as is well known in the art, to block predetermined passages corresponding to flow passages for the other streams. In FIG. 3, three passages 50, 51 and 52 are shown formed between pairs of spaced parting sheets 53, 54, 55, with the distribution fins such as fins 61 and 62 of FIG. 4 omitted. Also, for simplicity only 3 passages are shown with a fluid header for each stream. The number of active passages may exceed 100 and as many as five streams or more may be exchanged. In FIG. 3, the input through header A flows as shown by the arrows through passage 50 exiting header A1 while the input through header B flows as shown by the arrows through passage 51 exiting header B1 and the input through header C flows as shown by the arrows through passage 52 exiting through header C1.

Figure 4:
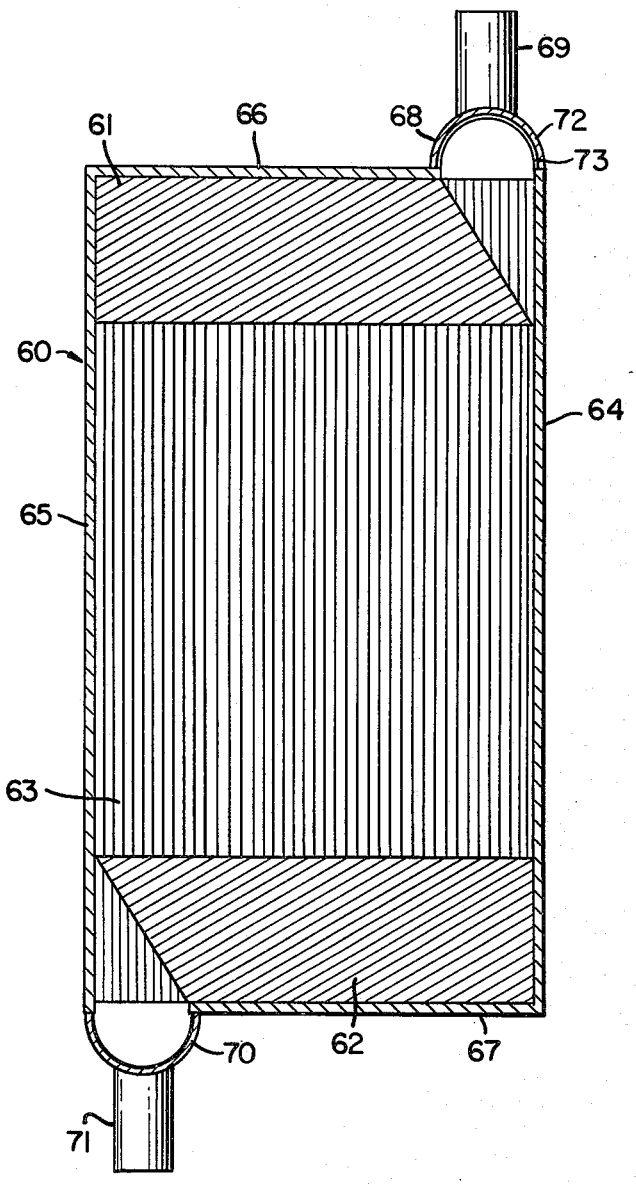
FIG. 4 illustrates a typical passage configuration utilized for the air/waste reversing heat exchanger unit taken along the lines 4—4 of FIG. 2 with only the manifold headers open to this passage shown.
Figure 6:
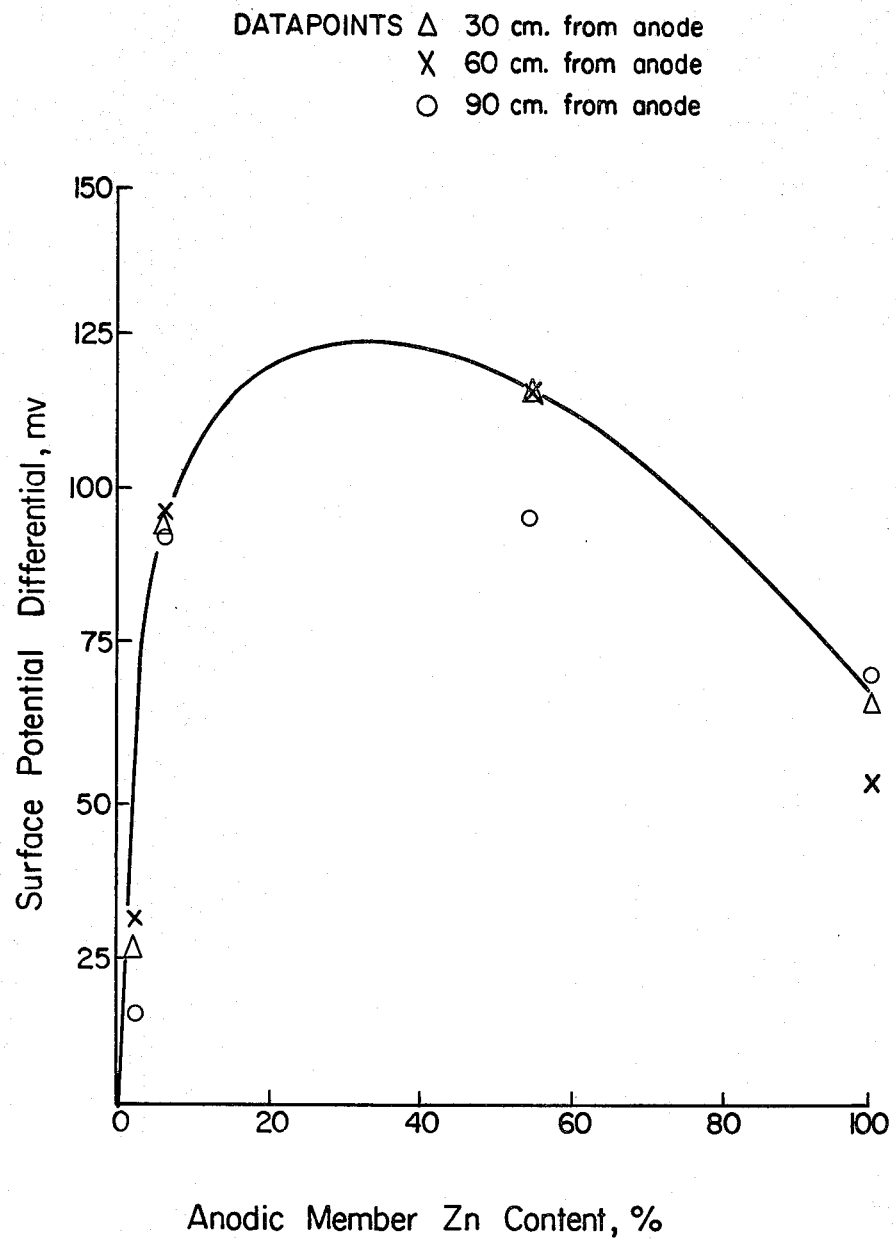
FIG. 6 illustrates test results of the surface potential developed across the sacrificial anode coating as a function of its zinc content and as a function of the sacrificial anode displacement from the cathode.

A typical single passage through the heat exchange core 7 for the air and waste stream is illustrated in FIG. 4. Flow distribution fin sections 62 and 61 are located at each opposite end of the heat transfer fin section 63. The fin sections are sealingly closed by the sidebars 64 and 65 and the end bars 66 and 67. The manifold headers 68 and 70 shown only in cross-section for the single passage, include fluid nozzles 69 and 71 that are used to connect the heat exchanger core to other plant piping.

An anodic coating 73 is applied over substantially the entire internal surface of the manifold headers associated with the air and waste streams respectively. Such placement of the coating ensures that the corrosion protection for the uncoated heat exchanger core, including the distribution fins, heat transfer fins, and parting sheets that separate the passages is maximized. It has been shown that during heat exchanger operation, all surfaces would be at least partially wetted by the water condensate thereby causing electrolytic action between the protective coating and the to-be-protected surfaces. The proximity of the protective coating to the heat exchanger would maximize the protected length of the heat exchanger and ensure that the entire water zone length of the unit would be protected. The effectiveness of the anodic coating material is characterized as its "throwing power". Placement of the protective coating on the internal surfaces of the headers immediately adjacent to the uncoated exchanger surfaces makes most effective utilization of the available throwing power.

As previously noted, it is desirable to minimize the impact of any corrosion protection technique on RHX unit fabrication procedures. This requirement is easily maintained by coating the internal surfaces of the headers prior to their attachment to the base core. As noted, essentially the entire internal surface area of the waste nitrogen and feed air headers is coated with a zinc alloy preferably using any suitable thermospray method. During such coating application, it may be desirable to mask off the edges of the headers (using approximately ½ inch of protective tape) to prevent any possibility of zinc alloying during the subsequent welding of the headers to the core unit. Such zinc alloying may adversely affect the integrity of a welded joint and is preferably avoided. The very small uncoated edge surface would not adversely affect the functioning of the protective coating. The coating is preferably applied by thermal spray methods which utilize a wire feedstock electric arc gun and inert gas atomization. Alternately, the coating can be applied utilizing an oxy-fuel spray gun with inert gas. Since it is generally advantageous to apply the coating by maintaining the spray gun normal to the surface that is coated and the header surface is non-uniform and generally in the shape of a partial cylindrical wall, it is desirable to utilize a suitable fixture to maintain the spray gun at a fixed distance from the surface coated and to change the orientation of the gun axis as required to maintain substantially perpendicular orientation during the spray process. Although it is preferable to utilize wire feedstock of the required alloy composition for the thermal spray gun, it is possible to apply the coating utilizing one wire of zinc and another wire of aluminum and essentially forming the alloy during the atomization and coating process. This separate wire feedstock coating process can be adapted for the electric arc spray gun where the different wires can be the two electrodes and the wire feed rates can be adjusted to regulate the resultant alloy composition. For the separate wire case, the resultant coating does not have the uniformity of composition possible with a uniform composition wire feedstock. However, such separate wire coating can result in substantially alloying during the coating step and offer significant corrosion protection for the desired application. As previously noted, the coating is applied only to the warm end air and waste gas headers since only those two heat exchanger passages are exposed to the water condensate. This limited treatment of headers has the obvious benefit of reducing associated costs.

Experimental tests have indicated that a zinc-aluminum alloy of about 10 to 65% zinc content and more preferably 20 to 50% zinc content offers galvanic action protection that exceeds that available from either pure zinc or low zinc content alloys. The experimental tests have also indicated that about 3% zinc with aluminum will offer corrosion protection about equivalent to pure zinc. Since zinc alone does offer corrosion protection, an acceptable coating composition can range from 3% zinc with aluminum to 100% zinc. It has been found that the cathodic protection associated with this invention is significant even though wetting of the surface occurs by water condensate that may be nonuniform.

The coating thickness satisfactory for this application will be a function of air separation plant parameters specific to each plant location. Generally, it is expected that coatings ranging from as low as 5 mils to as high as 100 mils would be acceptable for this application. More preferably, it is expected that the coatings would range from about 10 to 50 mils and still more preferably about 10 to 20 mils. The particular coating thickness utilized will depend on a combination of cost of coating, spalling resistance, adhesion strength and desired life of the unit. Generally speaking, it is expected that the thicker coatings would offer longer life to the heat exchanger compared to the thinner coating. On the other hand, it is expected that the thinner coatings would have more mechanical adhesion strength and spalling resistance relative to the thick coating. The two design considerations will be traded off as determined by design and economic considerations for any particular air separation plant application. Another factor would involve the corrosive agents expected for any given plant location. It is well-known that some plant locations have cleaner air than others and as such, for those cases a thinner coating may be satisfactory whereas the more severe industrial locations may require a thicker coating. Dependent on the plant location, the corrosive agents in the ambient air can be very diverse. However, usually the most detrimental agents are sulfur and chlorine compounds that can form acidic solutions with the water condensate. It is expected that atmospheric air sampling at the particular plant locations can be utilized to identify the nature and extent of corrosive agents present and there by serve as a guideline to establish the desirable protective coating thickness.

Figure 5:
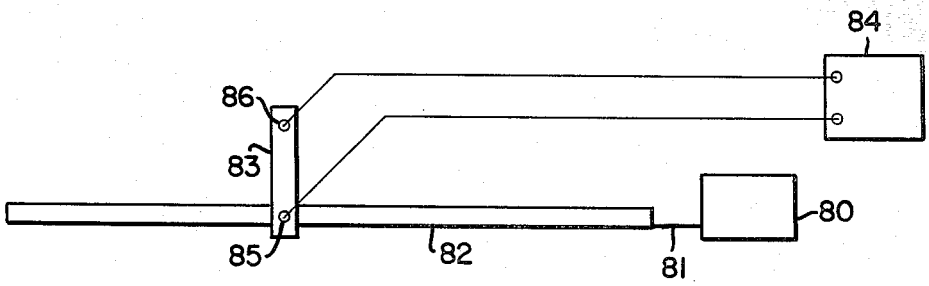
FIG. 5 illustrates an experimental test set up utilized to predict the corrosion protection provided by the sacrificial anode coating.

Experimental testing for corrosion protection methods can be a very difficult and long term procedure. Obviously, trial and error means of direct utilization of a proposed technique and subsequent examination of the article is not a very desirable procedure and involves time periods that are too long to be practical. Further, application of such tests means on any actual plant application is simply not practical from safety and production outage standpoints. Accordingly, the corrosion protection method associated with this invention was tested utilizing an experimental technique as is illustrated in FIG. 5. This procedure is well established as a method to determine pitting corrosive tendencies for a system and is described in the literature. (L. C. Rowe, *Journal of Materials*, Vol. 5, No. 2, June 1970, pg. 323–338). The procedure utilized the combination of an appropriate anode member 80 formed of the particular zinc alloy desired joined directly or by wire 81 to an aluminum test strip 82. The anode members simulated the anodic coating on the inside of the header whereas the aluminum strip would simulate the parting sheet associated with the reversing heat exchanger. This device was then coated with a water film simulating an RHX condensate that contained 20 ppm C1, 10 ppm $SO_4$, 2 ppm Cu in deionized water and acidified to a pH of about five. This solution simulates a particularly aggressive pitting corrosion environment representative of that found in plants with histories of premature core failures due to acid gas entrainment and heavy metal contamination. A probe 83 represented by a reference electrode 86 and a measuring electrode 85 is used to measure the surface potential difference along the aluminum strip 82 relating to the reference electrode as a function of distance from the anode surface 80. This technique involves the use of two calomel half cells as the reference and measuring electrodes 85 and 86. The measuring electrode 85 is held above the surface of the condensate film coated aluminum strip 80 by a fixed distance of about 1mm. The sacrificial test anodes were fabricated by melting reagent grade zinc and aluminum powders in a Thermolyne jeweler's furnace. Charges of each metal were first prepared by melting the pure powder then appropriate weights of each metal were remelted to form the binary alloys used. Aluminum zinc alloy bar members of 2, 6, and 55 and 100 wt. % zinc were cast. Homogeneity was ensured by reasonable melting times and by mechanical stirring. The anode bar members were cast as block members of nominally 4 cm. by 4 cm. by 1 cm. dimension. The aluminum cathode surface prepared from 3003-0 sheet stock was nominally 104 cm. long by 2.5 cm. wide with thickness of 32 mils. Test measurements were made by moving probe 83 along the length of the cathode strip and recording. The effect of zinc coupling and distance on the electrochemical potential field generated. This was determined by measurement of the shift in electrochemical potential from the uncoated or uncoupled condition to the coated coupled or protected condition. This electrochemical potential field is a measure of the corrosion protection afforded by the coating. The data represents the relative degree of corrosion protection or surface potential as a function of zinc content for three distances from the anodic surface of 30, 60 and 90 cm respectively. As can be seen there is a variation in generated potential difference or degree of corrosion protection as a function of zinc content with low zinc content and pure zinc being substantially worse compared to intermediate values of zinc content. Based on the test results, it can be concluded that a zinc content range of from about 10% to about 65% with aluminum remainder is more advantageous to other alloy concentrations. Aluminum is more advantageous than the remaining alloy concentrations. The preferred zinc content ranges from about 20 to 50% with an optimum of about 35% zinc. The entire range of about 3% zinc plus alloys is at least equivalent to pure zinc. Pure zinc offers significant corrosion protection to the aluminum substrate. Hence the entire range of 3% zinc with aluminum to pure zinc is an acceptable coating composition for the RHX application.

The test data shows that the degree of corrosion protection is not uniform as a function of zinc content but highly non-uniform. The test data is a representative indication of the conditions expected in reversing heat exchanger operation.

I claim:

1. In a brazed aluminum reversing heat exchanger for use in the cryogenic distillation of air comprising:

a heat transfer section including a multiplicity of substantially flat aluminum parting sheets arranged in parallel to form a stack having opposed ends, means for separating and sealingly engaging the peripheral ends of said sheets for enclosing said stack and defining fluid passageways between said sheets, heat transfer means interposed in said fluid passageways for providing extended heat transfer surfaces;

an input manifold arrangement of headers located at one end of said stack including at least a first header for introducing into said stack a compressed air feed stream substantially saturated with water vapor, a second header for withdrawing a waste gas from said stack and a third header for withdrawing from said stack a predetermined gaseous product, with the flow through said first and second headers being reversed at predetermined intervals;

an output manifold arrangement of headers located at the opposed end of said stack including, at least, a feed air outlet header, a waste gas inlet header and a product inlet header, each of which is coterminous with the corresponding header in the input manifold arrangement through said stack; and fluid distribution means located at each of the opposed ends of said stack for distributing the manifold flow of gases between the input manifold header arrangement and the output manifold arrangement through said heat transfer section wherein the improvement comprises:

coating means disposed on the inside surface of said first and second header in said input manifold arrangement for providing corrosion protection to said heat transfer section, said coating means comprising an alloy of zinc and aluminum with a zinc content in the range of 3 to 100% by weight.

2. In a brazed aluminum reversing heat exchanger as defined in claim 1 wherein said coating means is a relatively uniform layer of said alloy composition having a thickness between about 10 and 50 mils.

3. In a brazed aluminum reversing heat exchanger as defined in claim 2 wherein the zinc content of said alloy lies in a range of between about 10 and 65% by weight of the total alloy composition.

4. In a brazed aluminum reversing heat exchanger as defined in claim 3 wherein the zinc content range lies between 20 and 50% by weight of the total composition.

* * * * *